US007199777B2

(12) United States Patent
Moon

(10) Patent No.: US 7,199,777 B2
(45) Date of Patent: Apr. 3, 2007

(54) LIQUID CRYSTAL DISPLAY AND DRIVING METHOD THEREOF

(75) Inventor: Seung-Hwan Moon, Yongin (KR)

(73) Assignee: Samsung Electronics Co., Ltd, Suwon-si, Gyeonggi-do (KR)

( * ) Notice: Subject to any disclaimer, the term of this patent is extended or adjusted under 35 U.S.C. 154(b) by 595 days.

(21) Appl. No.: 10/664,075

(22) Filed: Sep. 17, 2003

(65) Prior Publication Data

US 2004/0246219 A1 Dec. 9, 2004

(30) Foreign Application Priority Data

Sep. 17, 2002 (KR) ..... 10-2002-0056508

(51) Int. Cl.
*G09G 3/36* (2006.01)
*G09G 5/00* (2006.01)

(52) U.S. Cl. ..... 345/89; 345/95; 345/210

(58) Field of Classification Search ..... 345/87–103, 345/208, 210–212
See application file for complete search history.

(56) References Cited

U.S. PATENT DOCUMENTS 3,114,112 A * 12/1963 Cochran ..... 330/265
6,118,421 A * 9/2000 Kawaguchi et al. ..... 345/89
6,359,607 B1 * 3/2002 Yanagi et al. ..... 345/94

* cited by examiner

*Primary Examiner*—Sumati Lefkowitz
*Assistant Examiner*—Rodney Amadiz
(74) *Attorney, Agent, or Firm*—MacPherson Kwok Chen & Heid LLP

(57) ABSTRACT

A liquid crystal display is provided, which includes: a liquid crystal panel including a gate line, a data line, and a pixel including a switching element connected to the gate line and the data line; a gate driver applying a gate signal for controlling the switching element to the gate line; and a data driver selecting gray voltages corresponding to gray signals and applying the selected gray voltages to the data line. The gate signal includes a gate-on voltage for turning on the switching element and a gate-off voltage for turning off the switching element. The gray voltages include pairs of positive and negative voltages ($V^+$, $V^-$) and $$\frac{V^+ + V^-}{2} = Vconst$$

for each gray, where Vconst indicates a predetermined level. The gate-on voltage continuously decreases from a first level to a second level for a predetermined time, and the first level (Von1) and the second level (Von2) satisfy a relation given by, $$\frac{Von1 + Vconst}{2} - \frac{Von1 + Vconst}{2} \times 10\% \leq Von2 \leq \frac{Von1 + Vconst}{2} + \frac{Von1 + Vconst}{2} \times 10\%.$$

15 Claims, 7 Drawing Sheets

LIQUID CRYSTAL DISPLAY AND DRIVING METHOD THEREOF

CROSS REFERENCE TO RELATED APPLICATION

This application claims the benefit of Korean Patent Application No. 10-2002-0056508 filed in the Korean Intellectual Property Office on Sep. 17, 2002, which is hereby incorporated by reference in its entirety for all purposes as if fully set forth herein.

BACKGROUND OF THE INVENTION (a) Field of the Invention

The present invention relates to a liquid crystal display and a driving method thereof.

(b) Description of the Related Art

Liquid crystal displays (LCDs) include two panels provided with pixel electrodes and a common electrode and coated with alignment layers and a liquid crystal (LC) layer with dielectric anisotropy, which is interposed between the two panels. The pixel electrodes are arranged in a matrix and connected to switching elements such as thin film transistors (TFTs). The switching elements selectively transmit data voltages from data lines in response to gate signals from gate lines. The common electrode covers entire surface of one of the two panels and is supplied with a common voltage. The pixel electrode, the common electrode, and the LC layer form a LC capacitor in circuital view, which is a basic element of a pixel along with the switching element connected thereto. Each pixel further includes a storage capacitor for enhancing the capacitance of the LC capacitor.

In the LCD, voltages are applied to the two electrodes to generate electric field in the LC layer, and the transmittance of light passing through the LC layer is adjusted by controlling the strength of the electric field, thereby obtaining desired images. In order to prevent image deterioration due to long-time application of the unidirectional electric field, polarity of data voltages with respect to the common voltage is reversed every frame, every row, or every dot.

When the LCD displays motion images or displays still images for a time interval, an afterimage is generated. The exemplary factors causing the afterimage are the concentration of ion impurity in the LC layer, the strength of the aligning force of the alignment layer, the kickback voltage, etc.

For example, ion impurity in the LC layer may be adsorbed due to inappropriate concentration thereof. The pixels are biased with a DC voltage generated by the ions even though there is no applied external field. The DC voltage affects the LC molecules to generate the afterimage.

The kickback voltage is a voltage drop before and after a voltage transition of a gate signal from a gate-on voltage for turning on the switching elements to a gate-off voltage for turning off the switching elements. The kickback voltage reduces both the positive data voltage and the negative data voltage to cause a DC voltage.

For reducing the afterimage, the concentration of the ion impurity in the LC layer is optimized, the aligning force of the alignment layer is maximized, and the kickback voltage is reduced.

A conventional technique for reducing afterimage generated due to the kickback voltage is to control the common voltage such that the voltages of the pixel electrode are symmetrical with respect to the common voltage. It is assumed that the positive data voltage and a negative data voltage for a gray to be applied to the pixel electrode are denoted as $V^+$ and $V^-$, respectively, and the kickback voltage is denoted as Vk. Then, the voltages of the pixel electrode are $(V^+-Vk)$ for the positive data voltage $V^+$ and $(V^--Vk)$ for the negative data voltage $V^-$. The common voltage Vcom is determined by a following equation:

$$(V^+-Vk)-Vcom=Vcom-(V^--Vk). \quad (1)$$

However, it is difficult to make the common voltage Vcom satisfy Equation 1 for all grays and, if possible, the established common voltage may not remove the afterimage.

SUMMARY OF THE INVENTION

A motivation of the present invention is to solve the problems of the conventional art.

A liquid crystal display is provided, which includes: a liquid crystal panel including a gate line, a data line, and a pixel including a switching element connected to the gate line and the data line; a gate driver applying a gate signal for controlling the switching element to the gate line; and a data driver selecting gray voltages corresponding to gray signals and applying the selected gray voltages to the data line, wherein the gate signal includes a gate-on voltage for turning on the switching element and a gate-off voltage for turning off the switching element and the gate-on voltage has at least two different levels.

Preferably, the gate-on voltage continuously varies for a predetermined time, and in particular, the gate-on voltage continuously decreases from a first level to a second level for the predetermined time.

The first level (Von1) and the second level (Von2) preferably satisfy a relation given by, $$\frac{Von1+Vconst}{2}-\frac{Von1+Vconst}{2}\times 10\% \leq Von2 \leq \frac{Von1+Vconst}{2}+\frac{Von1+Vconst}{2}\times 10\%,$$

where Vconst indicates a predetermined voltage level.

The gray voltages include a plurality of pairs of a positive voltage ($V^+$) and a negative voltage ($V^-$) assigned to each gray and it is preferable that $$\frac{V^++V^-}{2}=Vconst$$

for each gray.

The continuous decrease of the gate-on voltage from the first level to the second level is preferably linear.

The continuous decrease of the gate-on voltage from the first level to the second level is preferably performed around a time when the gate signal moves from the gate-on voltage to the gate-off voltage. The gate-on voltage preferably reaches the second level at a time when the gate signal moves from the gate-on voltage to the gate-off voltage.

Preferably, the liquid crystal display further includes a voltage generator including: a first switch selectively transmitting a first voltage; a first capacitor connected to the first switch and charging a voltage from the first switch; and a second switch connected to the first capacitor and forming a discharging path of the voltage charged in the first capacitor.

The voltage generator may further includes a resistor connected between the second switch and the first capacitor and the first switch discharges according to a time constant determined by a resistance of the resistor and a capacitance of the capacitor.

The voltage generator may further includes: a signal generator for generating a pulse signal with a predetermined period; a voltage divider diving the first voltage; and a second capacitor for charging a voltage from the voltage divider for turning on and turning off the first switch responsive to the pulse signal from the signal generator. Preferably, the first switch and the second switch are alternately activated based on the pulse signal from the signal generator.

The first switch may include a PNP bipolar transistor and the second switch may include an NPN bipolar transistor.

Preferably, the signal generator is connected to a base of the PNP bipolar transistor and is connected to a base of the NPN bipolar transistor via the first capacitor.

The voltage divider preferably includes comprises a first resistor and a second resistor connected in series between the first voltage and a ground and is connected to a base of the PNP generator, and $$\frac{Vbe2}{Vn} \leq \frac{1}{1+(R2/R1)} < \frac{Vbe2+(Vhigh-Vlow)}{Vn},$$

where R1 and R2 are resistances of the first and the second resistors, respectively, Vbe2 is a base-emitter voltage of the PNP transistor, Vn is a value of the first voltage, and Vhigh and Vlow are high and low levels of the pulse signal of the signal controller, respectively.

A method of driving a liquid crystal display including a plurality of gate lines, a plurality of data lines, and a plurality of pixels including switching elements connected to the gate lines and the data lines is provided, which includes: generating a plurality of pairs of a positive gray voltage ($V^+$) and a negative gray voltage ($V^-$) for respective grays satisfying $$\frac{V^+ + V^-}{2} = Vconst,$$

where Vconst is a predetermined value; generating a gate signal including a gate-on voltage for turning on the switching element and a gate-off voltage for turning off the switching element; applying the gate signal to the gate lines; and applying the gray signals to the data lines, wherein the gate-on voltage decreases from a first level (Von1) to a second level (Von2) for a predetermined time and $$\frac{Von1+Vconst}{2} - \frac{Von1+Vconst}{2} \times 10\% \leq Von2 \leq \frac{Von1+Vconst}{2} + \frac{Von1+Vconst}{2} \times 10\%.$$

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
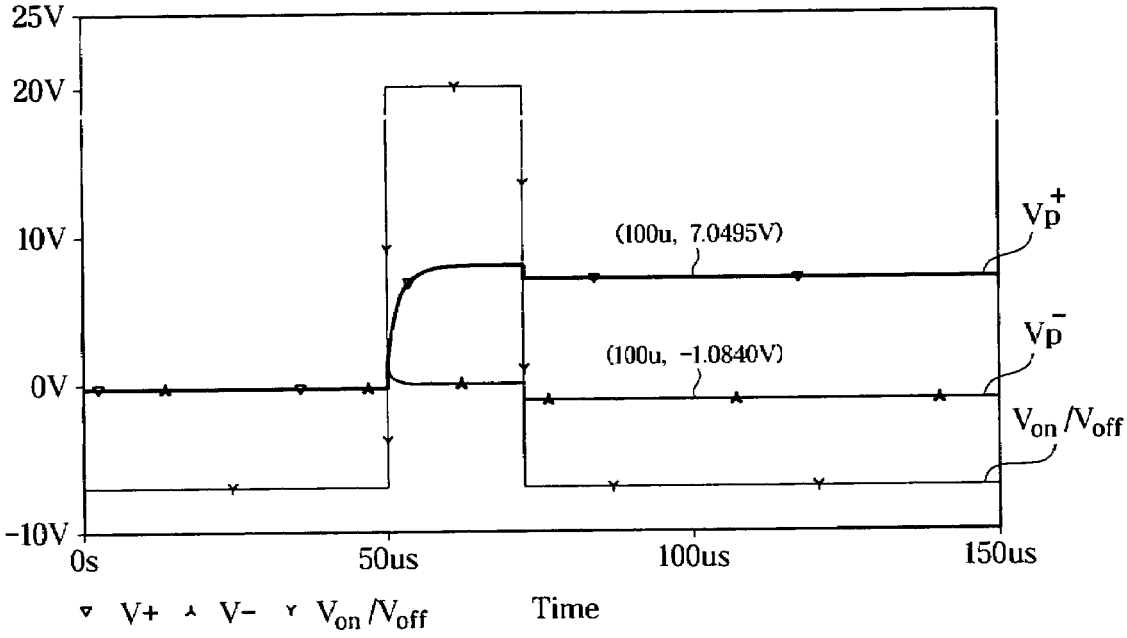
FIG. 1 is a graph showing waveforms of a gate signal and voltages of a pixel electrode according to an experiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

The inventors found that the conventional method indicated by Equation 1 may not completely solve the afterimage problem in an LCD due to the kickback voltage.

The kickback voltage Vk is determined by a following equation:

$$Vk = \frac{Cgd}{Cgd+Cst+Clc}(Von-Voff), \tag{2}$$

where Cgd is a gate-drain parasitic capacitance between a gate and a drain of a TFT, $C_{LC}$ is a capacitance of a LC capacitor (referred to as "LC capacitance" hereinafter), $C_{ST}$ is a capacitance of a storage capacitor (referred to as "storage capacitance" hereinafter), Von is a gate-on voltage, and Voff is a gate-off voltage.

First, the kickback voltage Vk for a positive voltage $V^+$ and a negative gray voltage $V^-$ for a gray is not equal since the parasitic capacitance Cgd is varied depending on a voltage applied to a pixel electrode.

The gate-drain capacitance Cgd sharply varies depending on a gate-drain voltage Vgd, which is a voltage difference between the gate and the drain of the TFT, equal to or higher than a threshold voltage of the TFT. In detail, the gate-drain capacitance Cgd increases as the gate-drain voltages Vgd increases. The respective gate-drain voltages $Vgd^+$ and $Vgd^-$ when applying the positive gray voltage $V^+$ and the negative gray voltage $V^-$ are:

$Vgd^{+}=Von-V^{+}$; and $$Vgd^{-}=Von-V^{-}. \quad (3)$$

Accordingly, a relation $Vgd^{-}>Vgd^{+}$ is always satisfied and thus the gate-drain capacitance Cgd under the application of the positive gray voltage $V^{+}$ is smaller than the gate-drain capacitance Cgd under the application of the negative gray voltage $V^{-}$. As a result, a kickback voltage $Vk^{+}$ under the application of the positive gray voltage $V^{+}$ and a kickback voltage $Vk^{-}$ under the application of the negative gray voltage $V^{-}$ satisfy a relation $Vk^{-}>Vk^{+}$.

FIG. 1 is a graph showing waveforms of a gate signal Von/Voff and voltages $Vp^{+}$ and $Vp^{-}$ of a pixel electrode according to an experiment of the present invention.

The gate signal Von/Voff including a low level (i.e., a gate-off voltage Voff) of about −7V and a high level (i.e., a gate-on voltage Von) of about 20V was applied to a pixel electrode. The value of a common voltage Vcom applied to a common electrode opposite the pixel electrode was 4V and positive and negative gray voltages $V^{+}$ and $V^{-}$ applied to the pixel electrode were 8V and 0V, respectively. $Vp^{+}$ and $Vp^{-}$ indicate the voltage of the pixel electrode under the application of the positive gray voltage $V^{+}$ and under the application of the negative gray voltage $V^{-}$, respectively. The gate-on voltage Von was applied to the pixel electrode from about 50 microseconds for about 25 microseconds.

The measured voltage $Vp^{+}$ of the pixel electrode before and after the voltage transition from the high level to the low level was about 8V and about 7.0495 V, respectively, and the measured voltage $Vp^{-}$ of the pixel electrode before and after the voltage transition from the high level to the low level was about 0V and about −1.0840 V. Accordingly, the kickback voltage $Vk^{+}$ under the application of the positive gray voltage $V^{+}$ is equal to about (8−7.0495)=0.9505V, while kickback voltage $Vk^{-}$ under the application of the negative gray voltage $V^{-}$ is equal to about (0−(−1.0840))=1.0840 V. The kickback voltages $Vk^{+}$ and $Vk^{-}$ are different from each other and satisfy the relation $Vk^{-}>Vk^{+}$.

Second, the kickback voltage Vk varies depending on the grays since the LC capacitance $C_{LC}$ varies depending on the grays.

Figure 2:
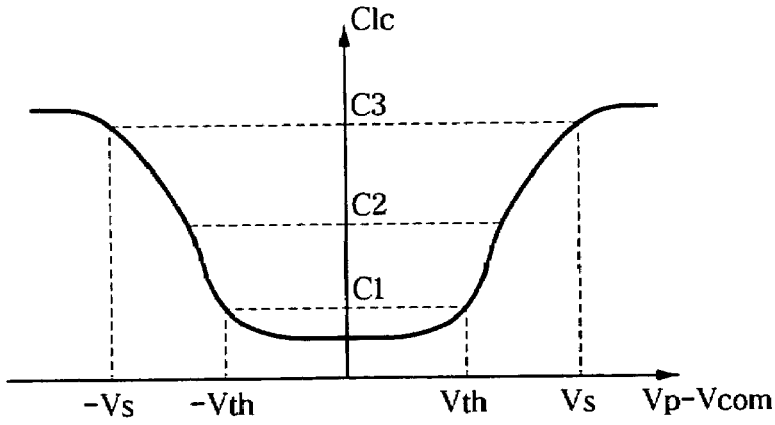
FIG. 2 is a graph showing a LC capacitance of a normally white twisted nematic (TN) mode LCD as function of a pixel voltage across a LC capacitor.

FIG. 2 is a graph showing the LC capacitance $C_{LC}$ of a normally white twisted nematic (TN) mode LCD as function of a pixel voltage (=Vp−Vcom) across the LC capacitor, i.e., a voltage difference between a voltage Vp of a pixel electrode and a common voltage Vcom. As shown in FIG. 2, the LC capacitance $C_{LC}$ varies depending on the pixel voltage (Vp−Vcom) while it exhibits a symmetry with respect to zero pixel voltage. In particular, the LC capacitance $C_{LC}$ drastically varies for the pixel voltages (Vp−Vcom) between Vth and Vs, and the LC capacitances $C_{LC}$ for the pixel voltages (Vp−Vcom) of Vth and Vs are indicated by C1 and C3, while C2 is an intermediate value between C1 and C3.

Now, liquid crystal displays according to embodiments of the present invention will be described.

Figure 3:
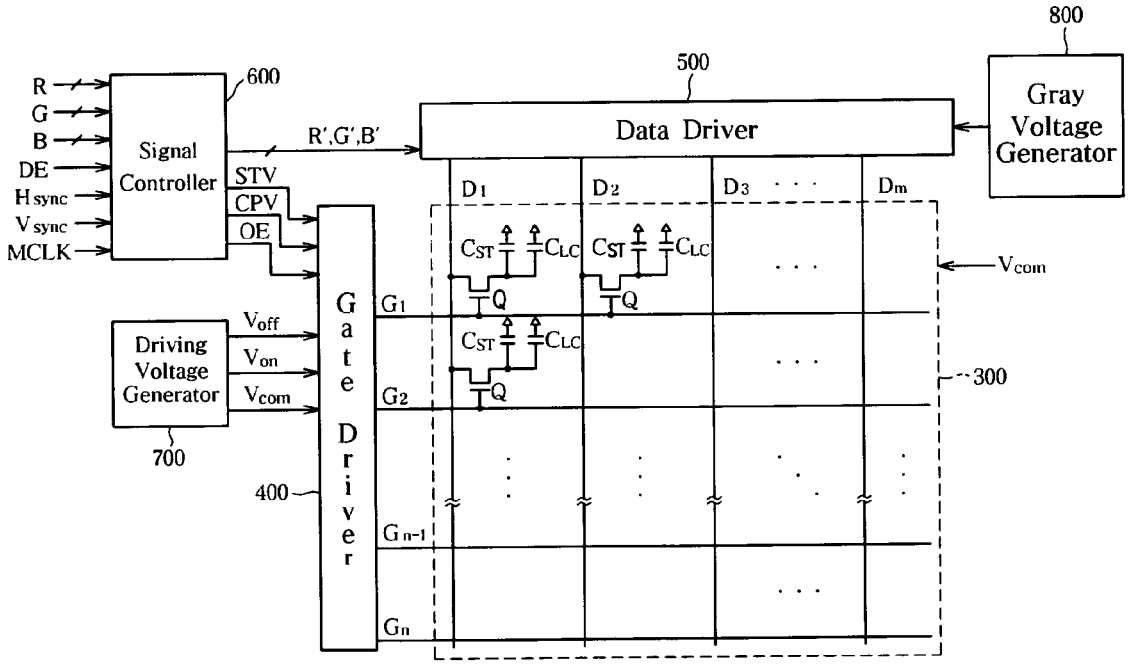
FIG. 3 is a block diagram of an LCD according to an embodiment of the present invention.
Figure 4:
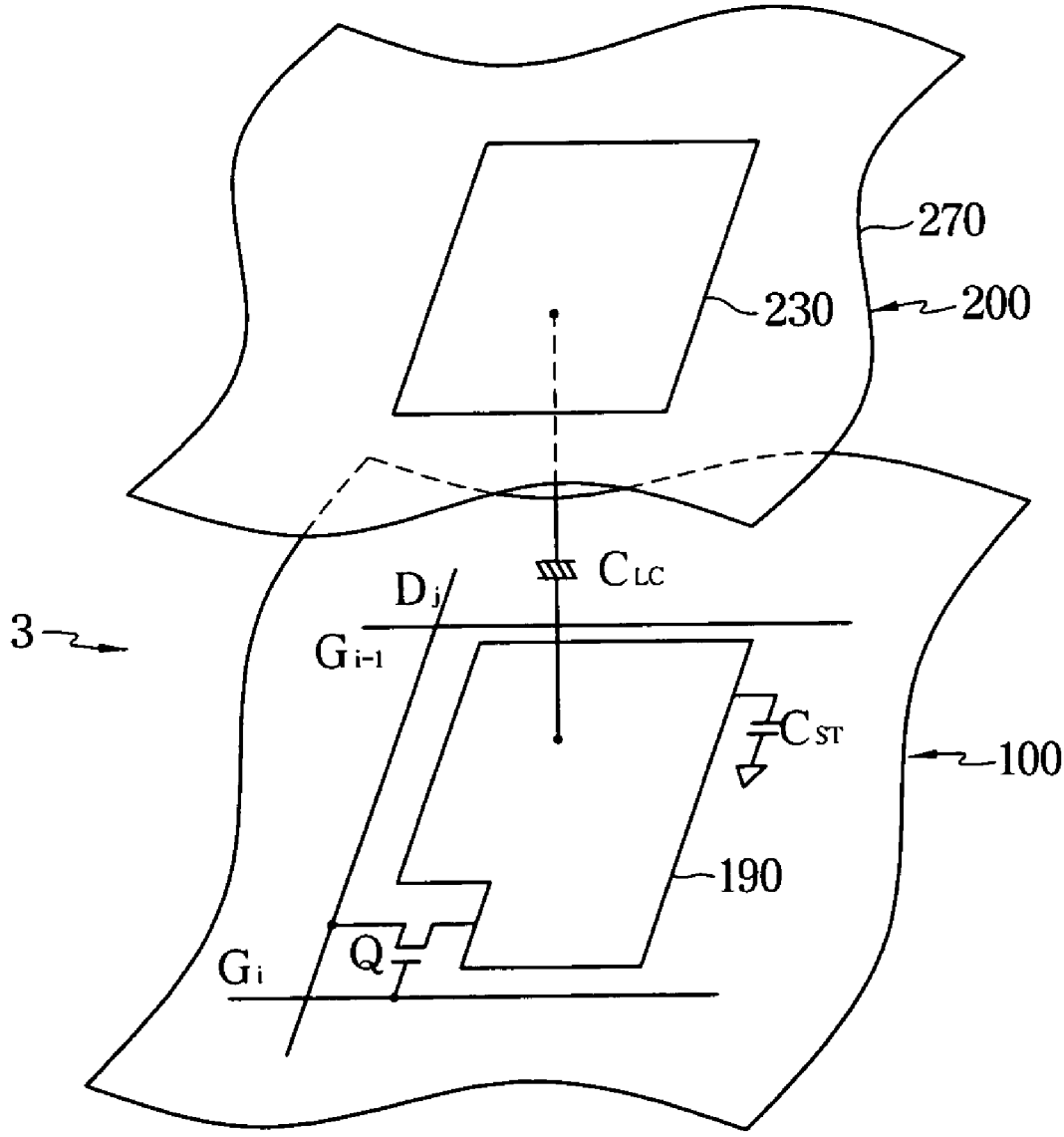
FIG. 4 is an equivalent circuit diagram of a pixel of an LCD according to an embodiment of the present invention.

FIG. 3 is a block diagram of an LCD according to an embodiment of the present invention, and FIG. 4 is an equivalent circuit diagram of a pixel of an LCD according to an embodiment of the present invention.

Referring to FIG. 3, an LCD according to an embodiment includes an LC panel assembly 300, a gate driver 400 and a data driver 500 which are connected to the panel assembly 300, a driving voltage generator 700 connected to the gate driver 400, a gray voltage generator 800 connected to the data driver 500, and a signal controller 600 controlling the above elements.

In circuital view, the panel assembly 300 includes a plurality of display signal lines G1–Gn and D1–Dm and a plurality of pixels connected thereto and arranged substantially in a matrix. In structural view shown in FIG. 4, the panel assembly 300 includes a lower panel 100, an upper panel 200 opposite the lower panel 100, and a LC layer 3 interposed therebetween.

The display signal lines $G_1$–$G_n$ and $D_1$–$D_m$ are provided on the lower panel 100, and include a plurality of gate lines $G_1$–$G_n$ transmitting gate signals (also referred to as "scanning signals") and a plurality of data lines $D_1$–$D_m$ transmitting data signals. The gate lines $G_1$–$G_n$ extend substantially in a row direction and substantially parallel to each other, while the data lines $D_1$–$D_m$ extend substantially in a column direction and substantially parallel to each other.

Each pixel includes a switching element Q connected to the signal lines $G_1$–$G_n$ and $D_1$–$D_m$, and a LC capacitor $C_{LC}$ and a storage capacitor $C_{ST}$ that are connected to the switching element Q. If necessary, the storage capacitor $C_{ST}$ may be omitted.

The switching element Q is provided on the lower panel 100 and has three terminals, a control terminal connected to one of the gate lines $G_1$–$G_n$, an input terminal connected to one of the data lines $D_1$–$D_m$, and an output terminal connected to both the LC capacitor $C_{LC}$ and the storage capacitor $C_{ST}$. FIGS. 3 and 4 show MOS transistors as the switching elements, which are implemented as TFTs including channel layers of amorphous silicon or polysilicon.

The LC capacitor $C_{LC}$ includes a pixel electrode 190 provided on the lower panel 100 and a common electrode 270 provided on the upper panel 200 as two terminals. The LC layer 3 disposed between the two electrodes 190 and 270 functions as dielectric of the LC capacitor $C_{LC}$. The pixel electrode 190 is connected to the switching element Q and the common electrode 270 is connected to the common voltage Vcom and covers entire surface of the upper panel 200. Unlike FIG. 4, the common electrode 270 may be provided on the lower panel 100, and both electrodes 190 and 270 have shapes of bar or stripe.

The storage capacitor $C_{ST}$ is defined by the overlap of the pixel electrode 190 and a separate wire (not shown) provided on the lower panel 100 and applied with a predetermined voltage such as the common voltage Vcom. Otherwise, the storage capacitor $C_{ST}$ is defined by the overlap of the pixel electrode 190 and its previous gate line $G_{i-1}$ via an insulator.

For color display, each pixel can represent one of three primary colors such as red, green and blue by providing corresponding one of a plurality of color filters 230 in an area corresponding to the pixel electrode 190. The color filter 230 shown in FIG. 4 is provided in the corresponding area of the upper panel 200. Alternatively, the color filters 230 are provided on or under the pixel electrode 190 on the lower panel 100.

A pair of polarizers (not shown) polarizing incident light are attached on the outer surfaces of the panels 100 and 200 of the panel assembly 300.

Referring to FIG. 3 again, the gray voltage generator 800 generates two sets of a plurality of gray voltages related to the transmittance of the pixels. The gray voltages in one set have a positive polarity with respect to the common voltage Vcom, while those in the other set have a negative polarity with respect to the common voltage Vcom. The positive gray voltage $V^{+}$ and the negative gray voltage $V^{-}$ for any gray satisfy a relation, $$\frac{V^{+}+V^{-}}{2}=Vconst, \tag{4}$$

where Vconst indicates a predetermined constant voltage.

The driving voltage generator 700 generates a gate-on voltage Von for turning on the switching elements Q and a gate-off voltage Voff for turning off the switching elements Q. The gate-on voltage Von has a high value Von1 for a predetermined duration while it has a sawtooth shape falling down form the high value Von1 to a low value Von2 during a remaining duration. The low value Von2 of the gate-on voltage Von is preferably given by:

$$\frac{Von1+Vconst}{2}-\frac{Von1+Vconst}{2}\times 10\% \leq Von2 \leq \frac{Von1+Vconst}{2}+\frac{Von1+Vconst}{2}\times 10\%. \tag{5}$$

The gate driver 400 is connected to the gate lines G1–Gn of the panel assembly 300 and applies gate signals to the gate lines G1–Gn, each gate signal being a combination of the gate-on voltage Von and the gate-off voltage Voff. The gate-on voltage Von in the gate signal is gradually reduced from the high value Von1 to the low value Von2 near the voltage transition of the gate signal from the gate-on voltage Von to the gate-off voltage Voff. For example, the gate-on voltage Von has the high value Von1 before the voltage transition of the gate signal, the magnitude of the gate-on voltage Von gradually decreases as the time becomes close to the voltage transition, and the gate-on voltage Von has the low value Von2 at the voltage transition.

The data driver 500 is connected to the data lines $D_1$–$D_m$ of the panel assembly 300 and selects gray voltages from the gray voltage generator 800 to apply as data signals to the data lines $D_1$–$D_m$.

The gate driver 400 and the data driver 500 may include a plurality of gate driving integrated circuits (ICs) and a plurality of data driving ICs, respectively. The ICs are separately placed external to the panel assembly 300 or mounted on the panel assembly 300. Alternatively, the ICs are formed on the panel assembly 300 like the signal lines $G_1$–$G_n$ and $D_1$–$D_m$ and the TFTs Q.

The signal controller 600 controls the gate driver 400, the data driver 500, and so on.

Then, operations of the LCD will be described with in detail.

The signal controller 600 is supplied from an external graphic controller (not shown) with RGB image signals R, G and B and input control signals controlling the display thereof, for example, a vertical synchronization signal Vsync, a horizontal synchronization signal Hsync, a main clock CLK, a data enable signal DE, etc. The signals controller 600 generates a plurality of gate control signals and a plurality of data control signals and processes the image signals R, G and B for the LC panel assembly 300 on the basis of the input control signals. The signal controller 600 provides the gate control signals for the gate driver 400 and the data control signals and the processed image signals R', G' and B' for the data driver 500.

The gate control signals include a vertical synchronization start signal STV for informing of start of a frame, a gate clock signal CPV for controlling the output time of the gate-on voltage Von and an output enable signal OE for defining the duration of the gate-on voltage Von.

The data control signals include a horizontal synchronization start signal STH for informing of start of a horizontal period, a load signal LOAD or TP for instructing to apply the appropriate data voltages to the data lines $D_1$–$D_m$, an inversion control signal RVS for reversing the polarity of the data voltages (with respect to the common voltage Vcom), and a data clock signal HCLK.

The data driver 500 receives a packet of the image data R', G' and B' for a pixel row from the signal controller 600 and converts the image data R', G' and B' into analog data voltages selected from the gray voltages from the gray voltage generator 570 in response to the data control signals from the signal controller 600.

Responsive to the gate control signals from the signal controller 600, the gate driver 400 applies the gate-on voltage Von to the gate line $G_1$–$G_n$, thereby turning on the switching elements Q connected thereto.

The data driver 500 applies the data voltages to the corresponding data lines $D_1$–$D_m$ during an on time of the switching elements Q due to the application of the gate-on voltage Von to gate lines $G_1$–$G_n$ connected to the switching elements Q (which is called "one horizontal period" or "1H" and equals to one periods of the horizontal synchronization signal Hsync, the data enable signal DE, and the gate clock signal CPV). Then, the data voltages in turn are supplied to the corresponding pixels via the activated switching elements Q.

The difference between the data voltage and the common voltage Vcom applied to a pixel is expressed as a charged voltage of the LC capacitor $C_{LC}$, i.e., a pixel voltage. The LC molecules have orientations depending on the magnitude of the pixel voltage and the orientations determine the polarization of light passing through the LC capacitor $C_{LC}$. The polarizers convert the light polarization into the light transmittance.

By repeating this procedure, all gate lines $G_1$–$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame is reversed (which is called "line inversion") or the polarity of the data voltages in one packet is reversed (which is called "dot inversion").

Now, a driving voltage generator for an LCD according to an embodiment of the present invention is described with reference to FIGS. 5 and 6.

Figure 5:
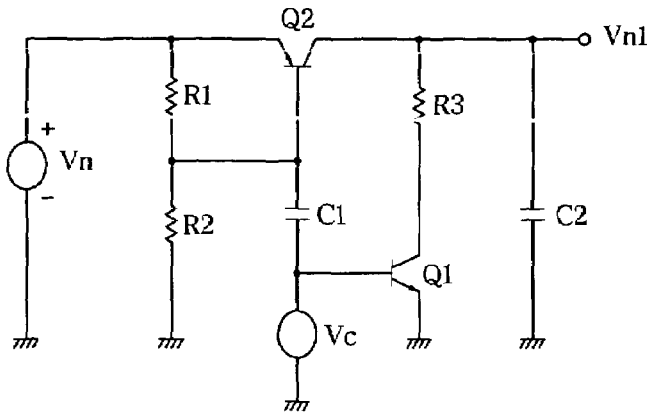
FIG. 5 is an exemplary circuit diagram of a gate-on voltage generating circuit for generating a gate-on voltage according to an embodiment of the present invention.

FIG. 5 is an exemplary circuit diagram of a gate-on voltage generating circuit of a driving voltage generator for generating a gate-on voltage according to an embodiment of the present invention.

Referring to FIG. 5, a gate-on voltage generating circuit according to an embodiment of the present invention includes a voltage divider including two resistors R1 and R2 connected in series between a voltage source Vn and a ground, an NPN transistor Q1, a PNP transistor Q2, a switching controller Vc, two capacitors C1 and C2, and a resistor R3.

The transistor Q2 has an emitter connected to the voltage source Vn, a base connected to the voltage divider R1 and R2, and a collector connected to an output Vn1 of the generator. The capacitor C1 is connected between the base of the transistor Q2 and the switch controller Vc, which is connected between the capacitor C1 and the ground and generates a periodic signal. The transistor Q1 has an emitter connected to the ground, a base connected to the switch controller Vc, and a collector connected to the output Vn1 through the resistor R3. The capacitor C2 is connected between the output Vn1 and the ground and may be a separate electronic element or may indicate a parasitic capacitor in an output path.

Now, the operation of the gate-on voltage generation circuit shown in FIG. 5 is described in detail with reference to FIG. 6, which shows waveforms of signals generated therein.

The output signals of the voltage source Vn and of the switch controller Vc are indicated by the same reference characters as the voltage source Vn and the switch controller Vc, respectively, and the resistances of the resistors R1, R2 and R3 and the capacitances of the capacitors C1 and C2 are indicated by the same reference characters as the resistors R1, R2 and R3 and the capacitors C1 and C2, respectively. The output signal from the output Vn1 is indicated by the same reference character as the output Vn1 and used as a gate-on voltage Von.

Figure 6:
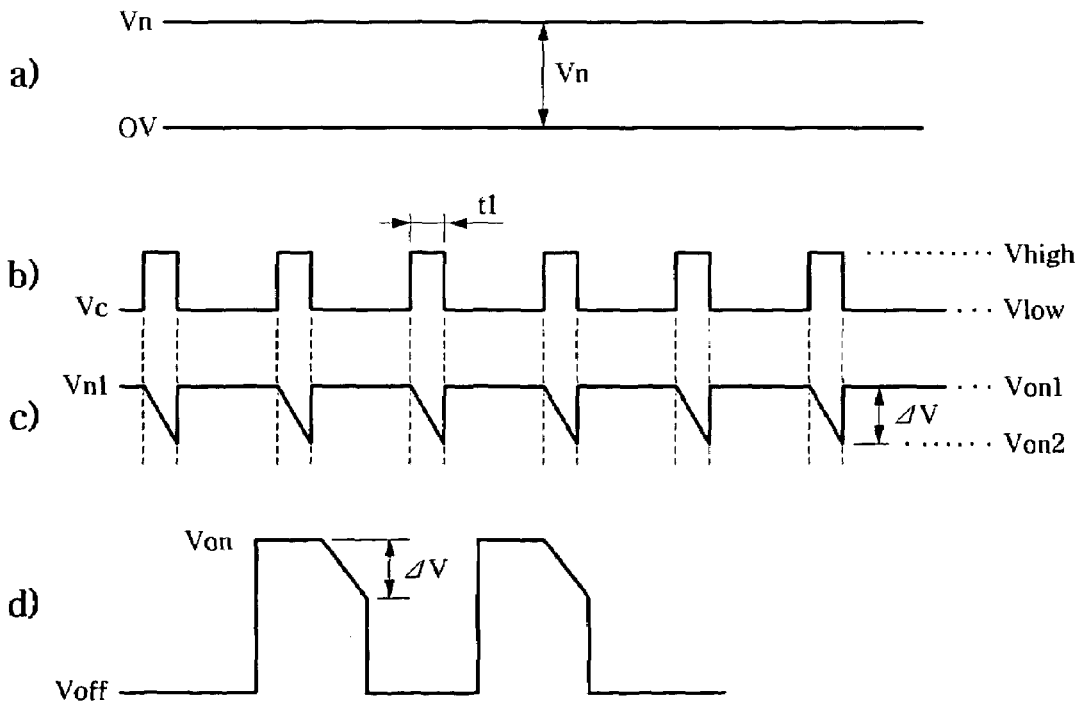
FIG. 6 shows waveforms of signals generated in the signal generator shown in FIG. 5.

The voltage source Vn provides a DC voltage Vn as shown in FIG. 6(*a*) and the switching controller Vc generates a periodic voltage signal Vc having a high value Vhigh for a predetermined time t1 and a low value Vlow for the remaining time as shown in FIG. 6(*b*). The voltage divider R1 and R2 drops the level of the voltage Vn from the voltage source Vc and the ratio of the resistances of the resistors R1 and R2 is determined by a reference to be described later.

When the voltage signal Vc from the switch controller Vc is the low level Vlow, a voltage across the capacitor C1 is equal to the voltage Vn divided by the voltage divider R1 and R2 and applied to the base of the transistor Q2. The transistor Q2 is then turned on if appropriately determined resistances of the resistors R1 and R2 are given.

Then, the output voltage Vn1 becomes to have a predetermined high level Von1 and the capacitor C2 is charged with the predetermined level of voltage.

When the voltage signal Vc from the switch controller Vc becomes the high level Vhigh, the voltage applied to the base of the transistor Q2 is abruptly increased since the voltage across the capacitor C1 tends to remain its level. The transistor Q2 is then turned off if appropriately determined resistances of the resistors R1 and R2 are given. The off state of the transistor Q2 can be remained for the time t1 if the resistance of the resistors R1 and R2 and the capacitance of the capacitor C1 are appropriately determined.

In addition, the transistor Q1 turns on to form a discharging path for the voltage charged in the capacitor C2. Accordingly, the voltage across the capacitor C2 and the output voltage Vn1 become decreased to a predetermined low level Von2 according to a time constant determined by the resistance of the resistor R3 and the capacitance of the capacitor C3, which exhibit a sawtooth wave as shown in FIG. 6(*c*).

A voltage variation ΔV (=Von1−Von2) of the output voltage Vn1 is given by:

$$\Delta V = Vn \times \left(1 - \mathrm{EXP}\left(-\frac{t1}{R3 \times C2}\right)\right). \tag{6}$$

Accordingly, the voltage variation ΔV is determined by the resistance R3 for fixed t1 and C2.

FIG. 6(*d*) shows a gate signal including a gate-on voltage Von made of the output voltage Vn1 of the gate-on voltage generation circuit.

Now, the conditions suitable for the operation of the gate-on voltage generator will be described.

The voltage drop across the resistor R1 is denoted as Vx, which is equal to $$\frac{R1 \times Vn}{R1 + R2}.$$

In order that the transistor Q2 is turned on by the voltage drop Vx when the voltage Vc has the low level Vlow, the voltage drop Vx satisfies a following relation:

$$Vx = \frac{R1 \times Vn}{R1 + R2} \geq Vbe2, \tag{7}$$

where Vbe2 is a base-emitter voltage of the transistor Q2. The voltage charged across the capacitor C1 equals to (Vn−Vx).

When the output voltage of the switch controller Vc increases from Vlow to Vhigh, the voltage applied to the base of the transistor Q2 is increased from (Vn−Vx) to ((Vn−Vx)+(Vhigh−Vlow)). Then, the requirement for turn off the transistor Q2 is given:

$$(Vn - Vx) + (V\mathrm{high} - V\mathrm{low}) > Vn - Vbe2. \tag{8}$$

From Relations 7 and 8, the ratio of the resistances R1 and R2 are determined by:

$$\frac{Vbe2}{Vn} \leq \frac{1}{1 + (R2/R1)} < \frac{Vbe2 + (Vhigh - Vlow)}{Vn}. \tag{9}$$

In the meantime, the off state of the transistor Q2 is required to maintain for the time t1 as described above.

For example, it is assumed that Vx=Vbe and the discharged charge is indicated by Qd.

Ignoring the discharge by the resistors R1 and R2, the amount of charges discharged by the transistor Q2 for the time t1 is equal to Ib×t1, where Ib indicates a base current of the transistor Q2. Since the charge increment stored in the capacitor C1 is equal to C1×(Vhigh−Vlow), a relation Qd=Ib×t1<<C1×(Vhigh−Vlow) is satisfied. Accordingly, the capacitance C1 satisfies a following relation:

$$C1 >> Ib \times t1/(V\mathrm{high} - V\mathrm{low}), \tag{10}$$

and accordingly, $$C1 >> Ib \times t1. \tag{11}$$

Considering the discharge of the resistor R1, a following relation is satisfied:

$$R1 \times C1 >> t1 \text{ or } R1 >> \frac{t1}{C1}. \tag{12}$$

FIGS. 7–11 are graphs showing waveforms of a gate signal Von/Voff including a gate-on voltage Von and a gate-off voltage Voff and a voltage of a pixel electrode according to experiments of the present invention.

Positive gray voltages applied to the pixel electrode were about 5V, 6.5V and 8V and negative gray voltages applied to the pixel electrode were about 3V, 1.5V and 0V, respectively. A high value Von1 of the gate-on voltage Von was about 20V and the gate-off voltage Voff was about −7V. The gate-on voltage Von was applied to the pixel electrode from about 50 microseconds for about 25 microseconds.

The voltage Vconst in Equation 4 is equal to about 4V, and a low value Von2 of the gate-on voltage Von determined by Relation 5 ranges about 10.8V to about 13.2V, which are averaged to about 12V.

Figure 11:
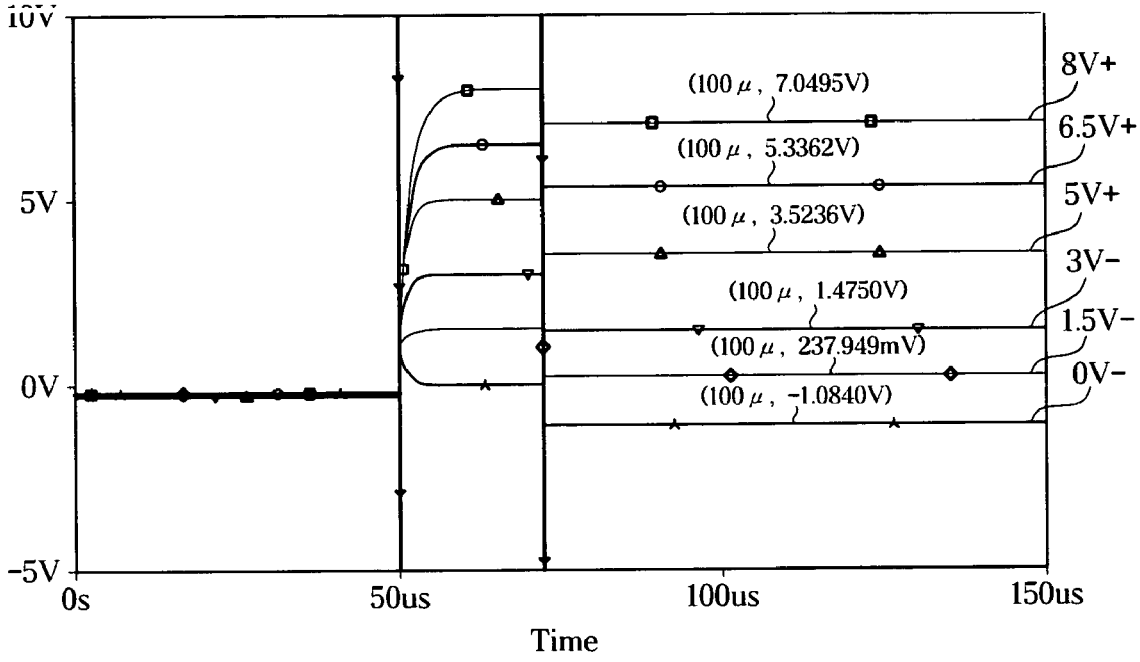

FIGS. 7, 8, 9 and 10 represent cases that the low values Von2 are 10V, 10.8V, 12V and 13.2V, respectively, while FIG. 11 represents a case that the gate-on voltage Von has a fixed level of 20V.

The graphs shown in FIGS. 7–11 are summarized in Table 1 and the result of analysis of Table 1 is illustrated in Table 2.

When the gate-on voltage Von of about 20V maintained constant as shown in FIG. 11, DC voltages of about 134 mV for the LC capacitance $C_{LC}$ of C3, about 98 mV for the LC capacitance $C_{LC}$ of C2, and about 49 mV for the LC capacitance $C_{LC}$ of C1 were remained.

Figure 7:
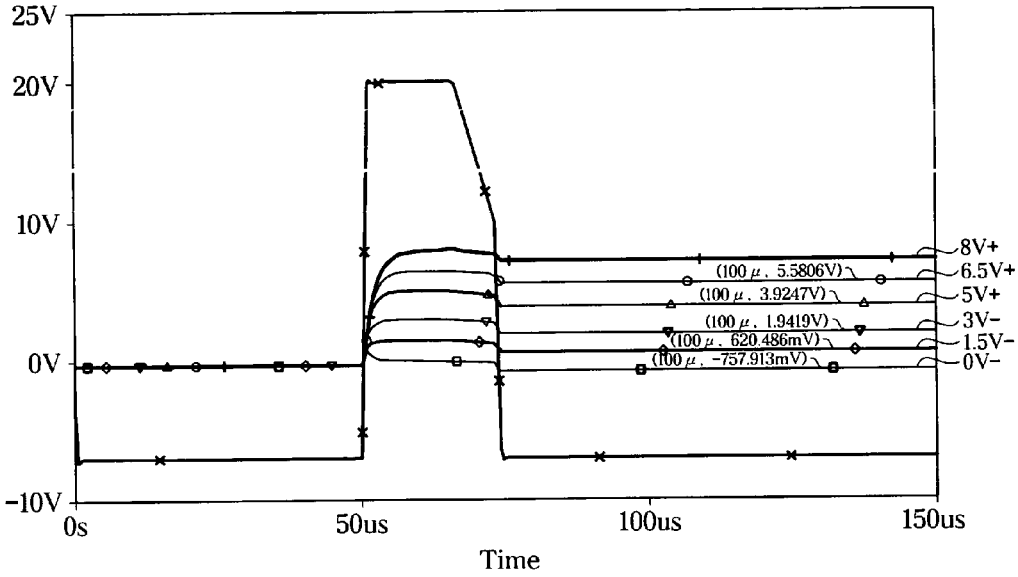
FIGS. 7–11 are graphs showing waveforms of a gate signal Von/Voff including a gate-on voltage Von and a gate-off voltage Voff and a voltage of a pixel electrode according to experiments of the present invention.

When the low value Von2 of the gate-on voltage Von was equal to about 10V as shown in FIG. 7, the kickback voltages $Vk^+$ and $Vk^-$ were much reduced. However, the kickback voltage difference ΔVk was still large.

Figure 9:
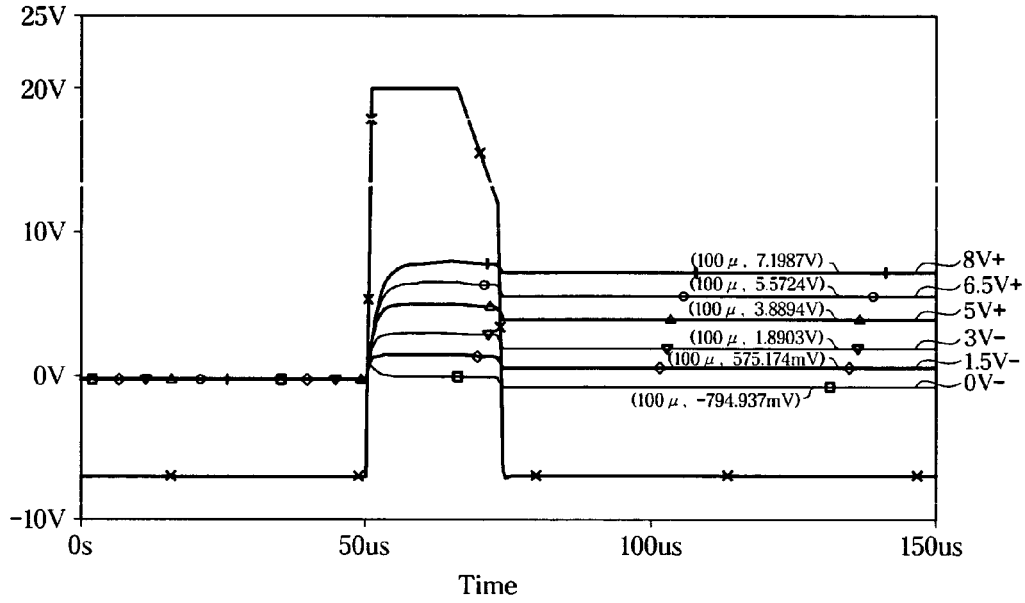
Figure 10:
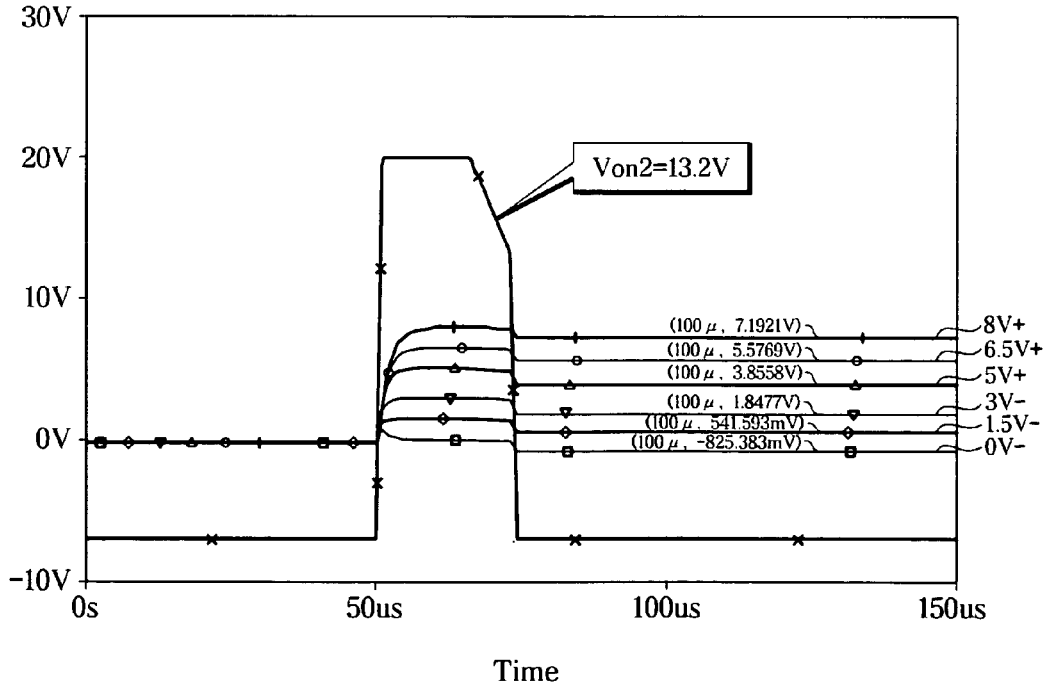

When the low value Von2 of the gate-on voltage Von was equal to about 12V, i.e., a mid-value ((Von1+Vconst)/2) in a range given by Relation 5 as shown in FIG. 9, the kickback voltage difference ΔVk was lower than 10 mV, which is very small. Accordingly, the remaining DC voltage was much reduced to hardly generate the afterimage.

Figure 8:
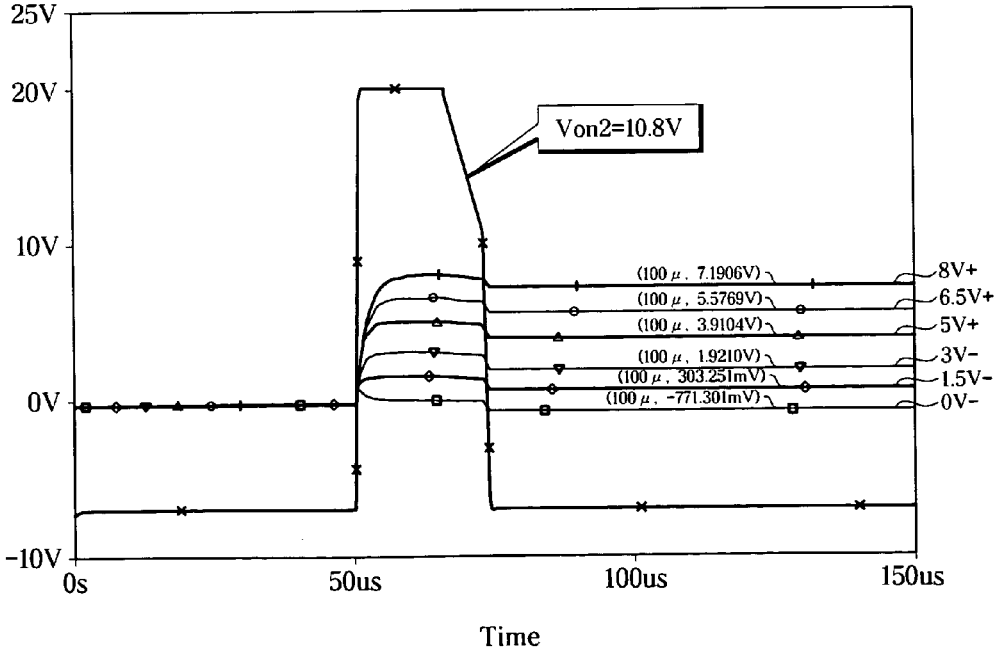

The kickback voltage differences ΔVk for the cases shown in FIGS. 8 and 11 had magnitudes larger than that shown in FIG. 9, but smaller than those shown in FIGS. 7 and 11. Since the difference (Max(ΔVk)−Min(ΔVk)) between the maximum kickback voltage difference Max (ΔVk) and the minimum kickback voltage difference Min (ΔVk) was reduced such that the afterimage on a screen as a whole was reduced. In particular, the case shown in FIG. 10 exhibited the kickback voltage difference ΔVk compared to that shown in FIG. 9.

TABLE 1

| Von1 | Von2 | $C_{LC}$ | $V^+$ | $V^-$ | $Vp^+$ | $Vp^-$ | $Vk^+$ | $Vk^-$ | ΔVk |
|---|---|---|---|---|---|---|---|---|---|
| 20 | 10 | C3 | 8 | 0 | 7.1863 | −0.757913 | 0.8137 | 0.757913 | 0.055787 |
| | | C2 | 6.5 | 1.5 | 5.5806 | 0.620486 | 0.9194 | 0.879514 | 0.039886 |
| | | C1 | 5 | 3 | 3.9247 | 1.9419 | 1.0753 | 1.0581 | 0.0172 |
| 20 | 10.8 | C3 | 8 | 0 | 7.1906 | −0.771301 | 0.8094 | 0.771301 | 0.038099 |
| | | C2 | 6.5 | 1.5 | 5.5769 | 0.603251 | 0.9231 | 0.896749 | 0.026351 |
| | | C1 | 5 | 3 | 3.9104 | 1.921 | 1.0896 | 1.079 | 0.0106 |
| 20 | 12 | C3 | 8 | 0 | 7.1987 | −0.794937 | 0.8013 | 0.794937 | 0.0006363 |
| | | C2 | 6.5 | 1.5 | 5.5724 | 0.575174 | 0.9276 | 0.924826 | 0.002774 |
| | | C1 | 5 | 3 | 3.8894 | 1.8903 | 1.1106 | 1.1097 | 0.0009 |
| 20 | 13.2 | C3 | 8 | 0 | 7.1921 | −0.825383 | 0.8079 | 0.825383 | −0.01748 |
| | | C2 | 6.5 | 1.5 | 5.5557 | 0.541593 | 0.9443 | 0.958407 | −0.01411 |
| | | C1 | 5 | 3 | 3.8558 | 1.8477 | 1.1442 | 1.1523 | −0.0081 |
| 20 | 20 | C3 | 8 | 0 | 7.0495 | −1.0840 | 0.9505 | 1.084 | −0.1335 |
| | | C2 | 6.5 | 1.5 | 5.3362 | 0.23795 | 1.1638 | 1.26205 | −0.09825 |
| | | C1 | 5 | 3 | 3.5236 | 1.4750 | 1.4764 | 1.525 | −0.0486 |

TABLE 2

| Von1 | Von2 | Max(ΔVk) | Min(ΔVk) | Max(ΔVk) − Min(ΔVk) |
|---|---|---|---|---|
| 20 | 10 | 55.8 mV | 17.2 mV | 38.6 mV |
| 20 | 10.8 | 38.1 mV | 10.6 mV | 27.5 mV |
| 20 | 12 | 6.4 mV | 0.9 mV | 5.5 mV |
| 20 | 13.2 | −8.1 mV | −17.5 mV | 9.4 mV |
| 20 | 20 | −48.6 mV | −133.5 mV | 84.9 mV |

In Table 1, $Vk^+$ is the kickback voltage under application of the positive gray voltages $V^+$, while $Vk^-$ is the kickback voltage under application of the negative gray voltages $V^-$, and $\Delta Vk = Vk^+ - Vk^-$. $Vp^+$ is the voltage of the pixel electrode under application of the positive gray voltages $V^+$, while $Vp^-$ is the voltage of the pixel electrode under application of the negative gray voltages $V^-$. The unit of the voltages is V, and C1, C2 and C3 are the values of the LC capacitance $C_{LC}$ shown in FIG. 2. That is, C1 and C3 are the values of the LC capacitance $C_{LC}$ at beginning and ending points of a range where the LC capacitance $C_{LC}$ drastically varies, and C2 is an intermediate value between C1 and C3.

In Table 2, Max(ΔVk) and Min(ΔVk) are defined as maximum and minimum values of the kickback voltage difference ΔVk, respectively.

Since the gate-on voltage Von shown in FIG. 11 has a fixed value, Table 1 and Table 2 describe the low value Von2 of the gate-on voltage Von to be equal to 20V, which is equal to the high value Von1.

Other experiments were performed by setting the high values Von1 of the gate-on voltage Von to be 25V and 35V and the low values Von2 thereof to be 14.5V and 19.5V, which are equal to ((Von1+Vconst)/2). The maximum kickback voltage difference Max(ΔVk), the minimum kickback voltage difference Min(ΔVk), and their difference Max (ΔVk)−Min(ΔVk) are illustrated in Table 3.

TABLE 3

| Von1 | Max(ΔVk) | Min(ΔVk) | Max(ΔVk) − Min(ΔVk) |
|---|---|---|---|
| 25 V | 4.8 mV | −2.2 mV | 7.0 mV |
| 35 V | 5.0 mV | 2.3 mV | 2.7 mV |

In these cases, remaining DC voltages are very small such that the degree of the afterimage is much reduced.

Other experiments were performed by varying the gate-off voltage Voff with the high values of the gate-on voltage Von as illustrated in Table 3. The maximum kickback voltage difference Max(ΔVk), the minimum kickback voltage difference Min(ΔVk), and their difference Max(ΔVk)−Min(ΔVk) are illustrated in Table 4.

TABLE 4

| Voff | Max(ΔVk) | Min(ΔVk) | Max(ΔVk) − Min(ΔVk) |
|---|---|---|---|
| −7 V | 5.0 mV | −2.3 mV | 2.7 mV |
| −15 V | −5.6 mV | −5.2 mV | 0.6 mV |

As shown in Table 4, the change of the gate-off voltage Voff does not affect the reduction of the kickback voltages. Accordingly, the kickback voltage reduction is obtained regardless of the magnitude of the gate-off voltage Voff.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a liquid crystal panel including a gate line, a data line, and a pixel including a switching element connected to the gate line and the data line;

a gate driver applying a gate signal for controlling the switching element to the gate line; and a data driver selecting gray voltages corresponding to gray signals and applying the selected gray voltages to the data line, wherein the gate signal includes a gate-on voltage for turning on the switching element and a gate-off voltage for turning off the switching element, wherein the gate-on voltage has at least two different levels, and wherein at least one of the at least two different levels of the gate-on voltage corresponds to a gray, wherein $$\frac{Von1 + Vconst}{2} - \frac{Von1 + Vconst}{2} \times 10\% \leq Von2 \leq \frac{Von1 + Vconst}{2} + \frac{Von1 + Vconst}{2} \times 10\%,$$

where Von1 indicates a first level and Von2 indicates a second level, and Vconst indicates a predetermined voltage level.

2. The liquid crystal display of claim 1, wherein the gate-on voltage continuously varies for a predetermined time.

3. The liquid crystal display of claim 2, wherein the at least two level includes a first level and a second level lower than the first level and the gate-on voltage continuously decreases from the first level to the second level for the predetermined time.

4. A liquid crystal display, comprising:

a liquid crystal panel including a gate line, a data line, and a pixel including a switching element connected to the gate line and the data line;

a gate driver applying a gate signal for controlling the switching element to the gate line; and a data driver selecting gray voltages corresponding to gray signals and applying the selected gray voltages to the data line, wherein the gate signal includes a gate-on voltage for turning on the switching element and a gate-off voltage for turning off the switching element and the gate-on voltage has at least two different levels, wherein the gate-on voltage continuously varies for a predetermined time, wherein the at least two level includes a first level and a second level lower than the first level and the gate-on voltage continuously decreases from the first level to the second level for the predetermined time, and wherein $$\frac{Von1 + Vconst}{2} - \frac{Von1 + Vconst}{2} \times 10\% \leq Von2 \leq \frac{Von1 + Vconst}{2} + \frac{Von1 + Vconst}{2} \times 10\%,$$

where Von1 and Von2 indicate the first and the second levels, respectively, and Vconst indicates a predetermined voltage level.

5. The liquid crystal display of claim 4, wherein the gray voltages include a plurality of pairs of a positive voltage ($V^+$) and a negative voltage ($V^-$) assigned to each gray and $$\frac{V^+ + V^-}{2} = Vconst$$

for each gray.

6. The liquid crystal display of claim 5, wherein the continuous decrease of the gate-on voltage from the first level to the second level is linear.

7. The liquid crystal display of claim 5, wherein the continuous decrease of the gate-on voltage from the first level to the second level is performed around a time when the gate signal moves from the gate-on voltage to the gate-off voltage.

8. The liquid crystal display of claim 7, wherein the gate-on voltage reaches the second level at a time when the gate signal moves from the gate-on voltage to the gate-off voltage.

9. The liquid crystal display of claim 1, further comprising a voltage generator including: a first switch selectively transmitting a first voltage; a first capacitor connected to the first switch and charging a voltage from the first switch; and a second switch connected to the first capacitor and forming a discharging path of the voltage charged in the first capacitor.

10. The liquid crystal display of claim 9, wherein the voltage generator further comprises a resistor connected between the second switch and the first capacitor and the first switch discharges according to a time constant determined by a resistance of the resistor and a capacitance of the capacitor.

11. The liquid crystal display of claim 9, wherein the voltage generator further comprises:

a signal generator for generating a pulse signal with a predetermined period;

a voltage divider diving the first voltage; and a second capacitor for charging a voltage from the voltage divider for turning on and turning off the first switch responsive to the pulse signal from the signal generator, wherein the first switch and the second switch are alternately activated based on the pulse signal from the signal generator.

12. The liquid crystal display of claim 11, wherein the first switch comprises a PNP bipolar transistor and the second switch comprises an NPN bipolar transistor.

13. The liquid crystal display of claim 12, wherein the signal generator is connected to a base of the PNP bipolar transistor and is connected to a base of the NPN bipolar transistor via the first capacitor.

14. A liquid crystal display, comprising:

a liquid crystal panel including a gate line, a data line, and a pixel including a switching element connected to the gate line and the data line;

a gate driver applying a gate signal for controlling the switching element to the gate line; and a data driver selecting gray voltages corresponding to gray signals and applying the selected gray voltages to the data line, and a voltage generator including:

a signal generator for generating a pulse signal with a predetermined period;

a voltage divider diving the first voltage; and a second capacitor for charging a voltage from the voltage divider for turning on and turning off the first switch responsive to the pulse signal from the signal generator, a first switch selectively transmitting a first voltage;

a first capacitor connected to the first switch and charging a voltage from the first switch; and a second switch connected to the first capacitor and forming a discharging path of the voltage charged in the first capacitor, wherein the gate signal includes a gate-on voltage for turning on the switching element and a gate-off voltage for turning off the switching element and the gate-on voltage has at least two different levels, wherein the first switch and the second switch are alternately activated based on the pulse signal from the signal generator wherein the first switch comprises a PNP bipolar transistor and the second switch comprises an NPN bipolar transistor, wherein the voltage divider comprises a first resistor and a second resistor connected in series between the first voltage and a ground and is connected to a base of the PNP generator, and $$\frac{Vbe2}{Vn} \leq \frac{1}{1+\left(\frac{R2}{R1}\right)} < \frac{Vbe2+(Vhigh-Vlow)}{Vn},$$

where R1 and R2 are resistances of the first and the second resistors, respectively, Vbe2 is a base-emitter voltage of the PNP transistor, Vn is a value of the first voltage, and Vhigh and Vlow are high and low levels of the pulse signal of the signal controller, respectively.

15. A method of driving a liquid crystal display including a plurality of gate lines, a plurality of data lines, and a plurality of pixels including switching elements connected to the gate lines and the data lines, the method comprising:

generating a plurality of pairs of a positive gray voltage ($V^+$) and a negative gray voltage ($V^-$) for respective grays satisfying $$\frac{V^+ + V^-}{2} = Vconst,$$

where Vconst is a predetermined value;

generating a gate signal including a gate-on voltage for turning on the switching element and a gate-off voltage for turning off the switching element;

applying the gate signal to the gate lines; and applying the gray signals to the data lines, wherein the gate-on voltage decreases from a first level (Von1) to a second level (Von2) for a predetermined time and $$\frac{Von1+Vconst}{2} - \frac{Von1+Vconst}{2} \times 10\% \leq Von2 \leq \frac{Von1+Vconst}{2} + \frac{Von1+Vconst}{2} \times 10\%.$$

* * * * *